US010378284B2

(12) United States Patent
Bayol et al.

(10) Patent No.: US 10,378,284 B2
(45) Date of Patent: Aug. 13, 2019

(54) SYSTEM FOR ROTARY DRILLING BY ELECTRICAL DISCHARGE

(71) Applicant: I.T.H.P.P., Thegra (FR)

(72) Inventors: Frédéric Bayol, Themines (FR); Boni Dramane, Figeac (FR); Jean-Louis Gaussen, Neuvic (FR); Christophe Goepfert, Orléans (FR)

(73) Assignee: I.T.H.P.P., Thegra (FR)

( * ) Notice: Subject to any disclaimer, the term of this patent is extended or adjusted under 35 U.S.C. 154(b) by 231 days.

(21) Appl. No.: 15/119,855

(22) PCT Filed: Feb. 20, 2015

(86) PCT No.: PCT/EP2015/053634
§ 371 (c)(1),
(2) Date: Aug. 18, 2016

(87) PCT Pub. No.: WO2015/124733
PCT Pub. Date: Aug. 27, 2015

(65) Prior Publication Data

US 2017/0067292 A1 Mar. 9, 2017

(30) Foreign Application Priority Data

Feb. 21, 2014 (FR) ..... 14 51428

(51) Int. Cl.
*E21B 7/15* (2006.01)
*E21B 41/00* (2006.01)
*E21B 3/00* (2006.01)

(52) U.S. Cl.
CPC ..... *E21B 7/15* (2013.01); *E21B 3/00* (2013.01); *E21B 41/0085* (2013.01)

(58) Field of Classification Search
CPC ..... E21B 3/00; E21B 41/0085; E21B 7/15
See application file for complete search history.

(56) References Cited

U.S. PATENT DOCUMENTS

| | | | |
|---|---|---|---|
| 5,845,854 | A | 12/1998 | Adam et al. |
| 5,949,729 | A | 9/1999 | Suyama et al. |
| 6,191,561 | B1 | 2/2001 | Bartel |
| 7,416,032 | B2 | 8/2008 | Moeny |
| 7,527,108 | B2 | 5/2009 | Moeny |
| 7,784,563 | B2 | 8/2010 | Rodland et al. |
| 8,109,345 | B2 | 2/2012 | Jeffryes |
| 9,279,322 | B2 | 3/2016 | Dirksen |
| 2005/0150688 | A1 | 7/2005 | MacGregor et al. |
| 2006/0191687 | A1 | 8/2006 | Storm et al. |
| 2009/0050371 | A1 | 2/2009 | Moeny |
| 2011/0100640 | A1 | 5/2011 | Bertram |
| 2011/0200881 | A1 | 8/2011 | Wang et al. |
| 2013/0032399 | A1 | 2/2013 | Dirksen |

(Continued)

FOREIGN PATENT DOCUMENTS

CN 101563520 10/2009

*Primary Examiner* — Caroline N Butcher
(74) *Attorney, Agent, or Firm* — Duane Morris LLP; Gregory M. Lefkowitz; Jason M. Nolan

(57) ABSTRACT

A downhole device for rotary drilling is provided. The device includes a power generator installed at the end of a series of rods, a pulse generator which is mechanically and electrically connected to the electricity generator, an electric drilling tool, and an electrical sliding switch system.

18 Claims, 16 Drawing Sheets

(56) References Cited

U.S. PATENT DOCUMENTS

| | | | | |
|---|---|---|---|---|
| 2013/0140086 | A1* | 6/2013 | Moeny | E21B 7/15<br>175/16 |
| 2013/0228373 | A1 | 9/2013 | Scholz | |

* cited by examiner

SYSTEM FOR ROTARY DRILLING BY ELECTRICAL DISCHARGE

CROSS-REFERENCE TO RELATED APPLICATIONS

This application is a § 371 national stage entry of International Application No. PCT/EP2015/053634, filed Feb. 20, 2015, which claims priority to French Patent Application No. 1451428 filed Feb. 21, 2014, the entire contents of which are incorporated herein by reference.

FIELD OF THE INVENTION

This invention relates to a device and a process of rotary drilling by electrical discharge and certain elements of the device.

TECHNICAL BACKGROUND

Conventional drilling techniques in the fields of Oil & Gas, Mining, Geothermal Energy, Civil Engineering and other activities consist of rotating a drilling tool downhole and at the same time applying a thrust force to it in the order of a few tons to several tens of tons. Rotation of the drilling tool is provided by rotation of the entire drill string from the surface (a system called "rotary drilling" in the art) or using a bottom hydraulic motor (turbodrilling). The drilling tools used are the tricone wheel type, PDC (Polycrystalline Diamond Compact) or impregnated matrix. In all cases, destruction of the rock is produced by mechanical effect. Rock cuttings produced by the tool are raised to the surface in the space between the walls of the hole and the drill string (the annulus) through the upward flow of drilling fluid.

However, these techniques suffer from slow forward progress in certain very hard or very abrasive geological formations. To resolve this problem, various alternatives to conventional techniques have been devised. Among these various attempts, a technique has been proposed based on repetitive injection of very high power electrical impulses directly into the ground through electrodes placed under the drilling tool. Electric arcs are produced between electrodes, penetrating the ground and creating a plasma tunnel. The expansion of gasses generated by the plasma fractures the rock and produces cuttings which are then eliminated in the conventional manner by fluid flow. This technique, well known for a long time, has different names in the literature such as "drilling be electrical discharge pulses", "plasma channel drilling process" or "pulsed electric rock drilling apparatus".

Document US005845854A, referring to previous publications, shows how to optimise the inter-electrode distance based on the voltage rise time. Document U.S. Pat. No. 6,164,388 gives equations to optimise operation and claims an optimised power circuit design using semiconductor rectifiers. Document WO-A-03/069110 provides orders of magnitude relative to the electrical parameters of this process (voltage, power, pulse duration). However, these three patents suffer from a major weakness, namely the supply of electric power to the electrodes. Indeed, the pulse generator for these system is located at the surface. A means of transmission (by cable or other system) is therefore necessary to connect the surface to the borehole bottom, which leads to complexity and safety concerns.

Certain documents highlight the combination of this technique with other processes. Thus, document U.S. Pat. No. 7,416,032 refers to a system for drilling by electrical discharge with a combination of electrical and mechanical effects. Document U.S. Pat. No. 7,527,108 refers to a portable system for drilling by electrical discharge in a mining context for linear metric boreholes. Document U.S. Pat. No. 7,784,563 refers to a system for drilling by electrical discharge, including a mechanism to maintain continuous contact between the rock and the electrodes. Document EP2554780 presents a combination of a system for drilling by electrical discharge and a process for cooling and pulsation of the drilling fluid. Document EP2554778 presents a combination of a system for drilling by electrical discharge, a system of sensors for directional drilling and a LWD (Logging While Drilling) system.

All these documents present the same weakness: despite the presence of the pulse generator at the bottom of the borehole, the electric power required to supply it is provided by a cable from the surface. However, the presence of a cable is a major obstacle which conflicts with the operational use of these systems. Indeed, in the case of using conventional drill strings, the presence of a cable prevents their rotation. Such a handicap contradicts a fundamental rule of the profession: to be able at any moment to turn the rod casing.

Certain documents however suggest the possibility of using a downhole electricity generator to power a system for drilling by electrical discharge, such as for example documents US2009/00500371, U.S. Pat. Nos. 8,109,345 and 7,784,563. However, these documents provide no details on the operation of the system in such a configuration, the first document being only on a non-rotating system. However, one of the main advantages of a downhole electricity generator is the ability to turn the drill string from the surface. In addition, for using a downhole electricity generator, these documents do not address the following three essential questions: control of the systems' operation from the surface, the safety of personnel in relation to the risk of high voltage when lifting out the drill string and compatibility with the use of a MWD (Measurement While Drilling) system which is almost routine these days, especially for oil drilling.

SUMMARY OF THE INVENTION

Schematically, the downhole equipment is incorporated at the end of a drill string (an assembly of drill pipes and collars) and is composed of four main components:

an electricity generator,
a pulse generator,
an electrical slide switch,
an electric drilling tool.

The electricity generator converts the hydraulic energy of the drilling fluid into electrical energy and delivers an electric current which powers the pulse generator.

The pulse generator typically comprises of capacitors and power switches. The capacitors are fed by the electricity generator. The power switches deliver repetitive high voltage pulses to the electrodes of the electric drilling tool.

The electric drilling tool is equipped with a system of electrodes. The system of electrodes is comprised of high voltage electrodes (electrically connected to the pulse generator capacitors) and electrodes to ground.

The electrical slide switch enables controlling from the surface, in a simple and reliable manner, the electrical operation of the system, without a transmission cable.

In parallel with implementation of the electrical process, the drill string is rotated conventionally from the surface since no cable or other system for transmission of electrical energy interferes with this movement. Thus, the driller has a system fully compatible with the drill rig and standard procedures, while providing control of the electrical operation of the downhole system through the electrical slide switch.

The electrical slide switch allows remote control and makes the system functional and safe.

The invention therefore overcomes these deficiencies by providing a drilling system by electrical discharge which does not require any electrical connection with the surface and which allows operation of the downhole system to be controlled from the surface in a simple and safe manner. The invention is also fully compatible with standard drilling rig equipment as well as with conventional drilling procedures. The invention therefore provides safety, reliability and performance.

Thus, the invention provides a downhole device for rotary drilling comprising:

- an electricity generator installed at the end of a string of drill pipes and/or drill collars and which converts the drilling fluid's hydraulic energy into electrical energy;
- a pulse generator mechanically and electrically connected to said electricity generator, and powering a system of electrodes carried by the drilling tool;
- an electric drilling tool, connected mechanically and electrically to said pulse generator, rotated by the string of drill pipes and/or drill collars and consisting of a system of active and passive electrodes; and
- an electrical slide switch system.

According to one embodiment, the sliding switch system (9) is incorporated (i) with the said electric drilling tool (7) or (ii) at the interface between the said electrical drilling tool (7) and the said pulse generator (6) or (iii) with the said pulse generator (6) or (iv) between the said pulse generator (6) and the said electricity generator (5) or (v) with the said electricity generator (5) or (vi) above the said electricity generator (5).

According to one embodiment, the device comprises two slide switches:

- a first electrical slide switch between the part of the electricity generator which converts the hydraulic energy into mechanical energy and the part of the electricity generator which converts the mechanical energy into electrical energy, such that when in the "open" position, this switch prevents production of electricity, even if drilling fluid is circulating in the said hydraulic compartment; and
- a second electrical slide switch at the electric drilling tool such that when in the "open" position this switch forces discharge of the capacitors (16) of the said pulse generator and prevents their charging even when the electrical compartment is producing an electrical current.

According to one embodiment, rotation of the said electric drilling tool combines the mechanical effect of the said passive electrodes with the effect of electrical discharges.

According to one embodiment, rotation of the said electric drilling tool sweeps the entire surface of the hole with radial electric arcs which are produced between the said passive and active electrodes.

According to one embodiment, the said slide, playing the role of an electric switch, is normally open by means of a mechanical spring holding the said slide open and the open state of the power circuit of the said pulse generator and the "short-circuited" state of the capacitors through a circuit which connects the two terminals of the said capacitors to a discharge resistor.

According to one variant, the "normally open" position of the said slide is reinforced by a positive action triggered from the surface by injection of drilling fluid in the casing.

According to one embodiment, switching from the open position to the closed position of the said switch is enabled by a positive action triggered from the surface consisting of applying a weight on the said electric drilling tool.

According to one embodiment, in the device according to the invention:

- the electricity generator comprises a turbine or positive displacement motor, whose rotor, driven in rotation by the flow of drilling fluid, in turn drives the alternator rotor,
- the interface between the said rotor of the said turbine or the said motor and the said rotor of the said alternator comprises an electrical slide switch permitting mechanical clutching.

According to one embodiment, in the device according to the invention:

- the said system of active and passive electrodes comprises two groups of electrodes electrically insulated from one another but mechanically joined to one another both from an axial point of view and from an angular point of view, said group comprising (i) a group of passive electrodes, grounding electrodes, and (ii) a group of active electrodes, high voltage electrodes; or
- the said system of active and passive electrodes comprises two groups of electrodes electrically insulated from one another but mechanically uncoupled from one another from an angular point of view but not uncoupled from an axial point of view, the said group comprising (i) a group of passive electrodes, grounding electrodes, located in the periphery of the said electric drilling tool, and a group of active electrodes, high voltage electrodes, located centrally in the said electrical drilling tool, and not mechanically joined to the group of passive electrodes such that it is not driven in rotation by it; or
- the said system of active and passive electrodes comprises two groups of electrodes electrically insulated from one another but mechanically uncoupled from one another both from an angular point of view and from an axial point of view, said group comprising (i) a group of passive electrodes, grounding electrodes, located in the periphery, and (ii) a group of active electrodes, high voltage electrodes, located centrally in the said electric drilling tool, equipped with an axial track of preferably several centimeters and subjected to the force of a bellows spring enabling the electrodes to be in continuous contact with the rock; or
- the said system of active and passive electrodes comprises two groups of electrodes electrically insulated from one another but mechanically attached to one another from an angular point of view and but not mechanically attached to one another from an axial point of view, said group comprising (i) a group of passive electrodes, grounding electrodes, and (ii) a group of active electrodes, high voltage electrodes, located off-centre relative to the axis of the said electric drilling tool, equipped with an axial track of preferably several centimeters and subjected to the force of a bellows spring allowing the electrodes to be in continuous contact with the rock.

According to one embodiment, the terminal part of the electric drilling tool comprises an internal chamber free of any solid materials other than electrodes.

According to one embodiment, the said pulse generator is crossed in its axis by a hollow axial tube in insulating material connected mechanically at the lower part of the said pulse generator with a metal tube such that the continuum of the said tubes provides for transmission of the drilling fluid and that the said lower metal tube, and preferably only this tube, receives the electrical discharges from the said pulse generator.

According to one embodiment, the said pulse generator is a LTD Linear Transformer Driver type generator or a Marx generator or a TESLA transformer.

According to one embodiment, several modules composed of energy storage devices, preferably capacitors, and power switches, preferably gas discharge tubes, are stacked on one another in the annular space located between the said hollow tube and the exterior metal envelope.

According to one variation, the said power switches consist of annular electrodes having the form of a ring.

According to one embodiment, the device also includes an insulating connector consisting of two metal parts, an upper part and a lower part, separated by an insulating material and nested between them to transmit the axial stresses as well as the torque stresses between the said upper part and the said lower part.

According to one embodiment, the electrodes comprise inserts of hard and abrasive material, preferably of Polycrystalline Diamond Compact (PDC) type or tungsten carbide and/or metal matrix comprising a powder or microparticles of hard material, preferably diamond.

The invention also relates to a rotary drilling device, comprising the downhole device according to the invention which is incorporated at the end of a drill string comprising an assembly of drill pipes and possibly drill collars for transmission of the electrical energy and a drilling rig comprising a system for rotary driving of a string of drill pipes and/or drill collars, and drilling pumps for injection of drilling fluid inside the string of drill pipes and/or drill collars.

The invention further relates to a drilling process through rotation of the rotary drilling device according to the invention.

- 1: drilling rig equipped with a derrick, mast or other handling system,
- 2: system for rotation of the drill string,
- 3: pumps for injection of drilling fluid under high flow and high pressure,
- 4: a string of drill pipes and/or drill collars,
- 5: an electricity generator,
- 6: pulse generator,
- 7: electric drilling tool,
- 8: stabiliser
- 9: electrical slide switch positioned at the electric drilling tool,
- 10: system of electrodes.

Figure 1:
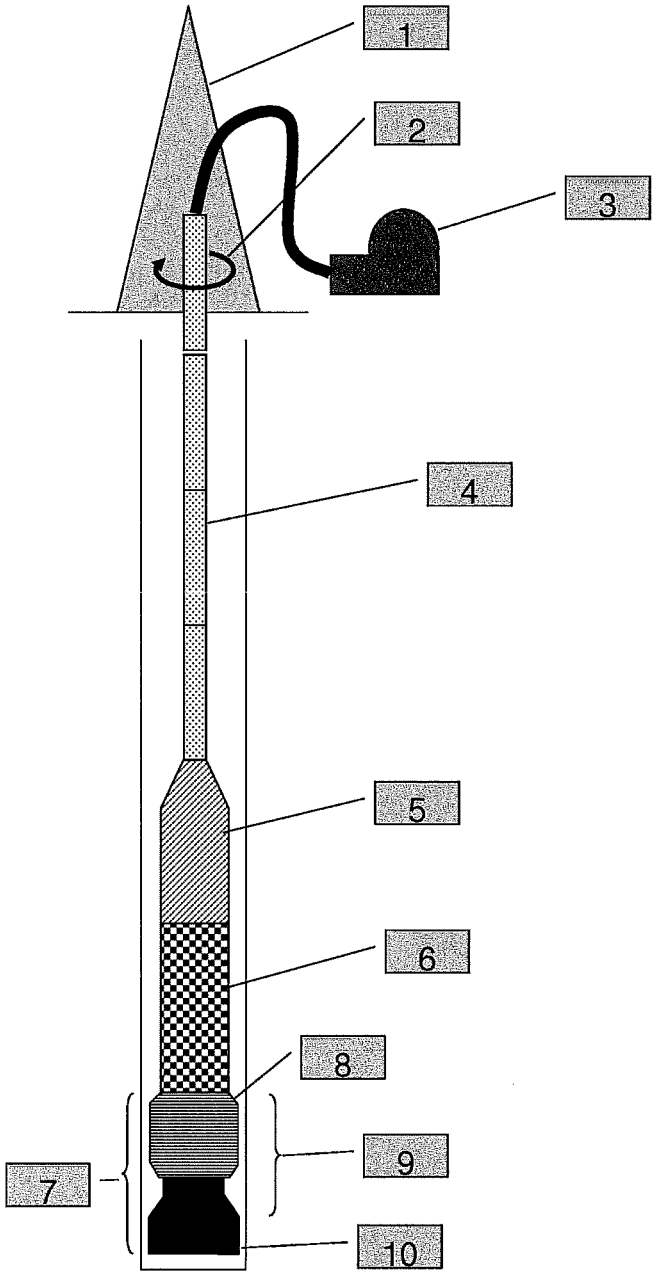
FIG. 1 represents an overall system in the "slider positioned at the level of the electric drilling tool" configuration. In this.
Figure 2:
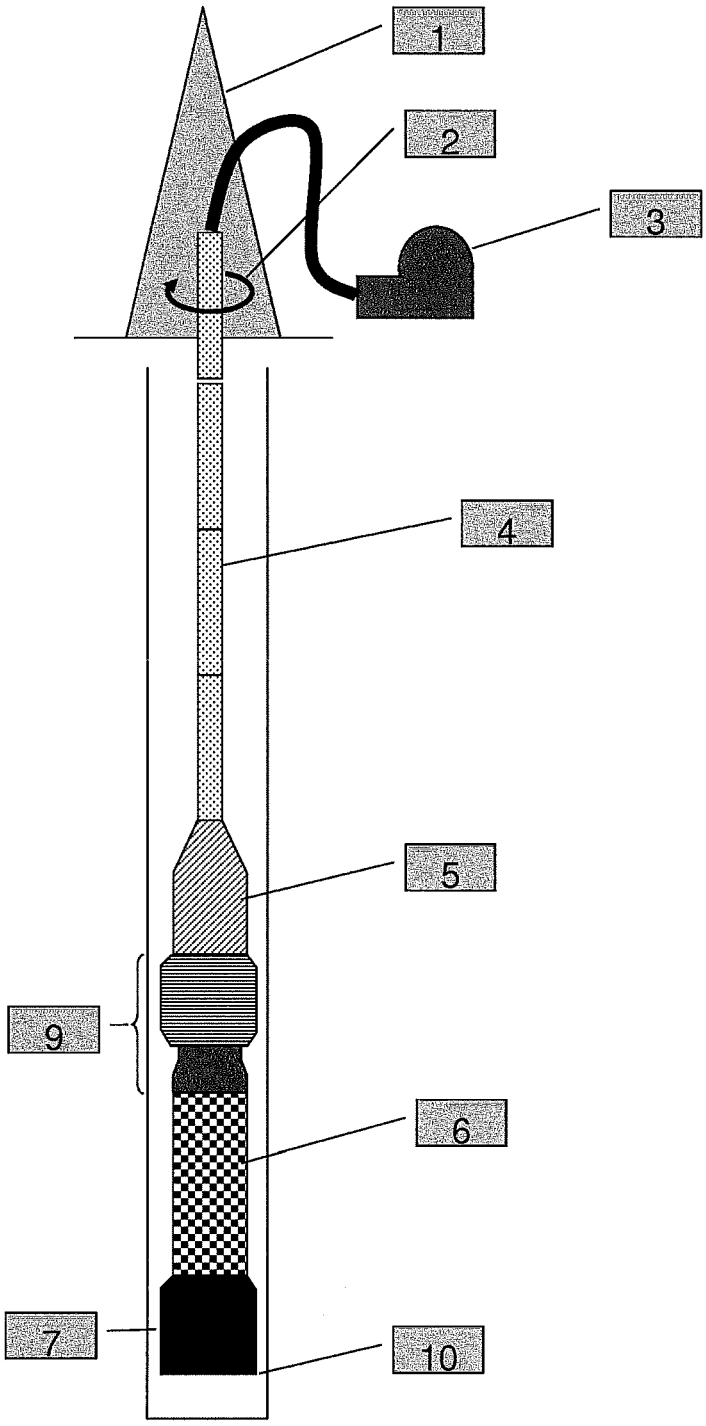

FIG. 2 represents an overall system in "slider positioned between the electricity generator and the pulse generator" configuration. The legend of FIG. 1 applies mutatis mutandis.

Figure 3:
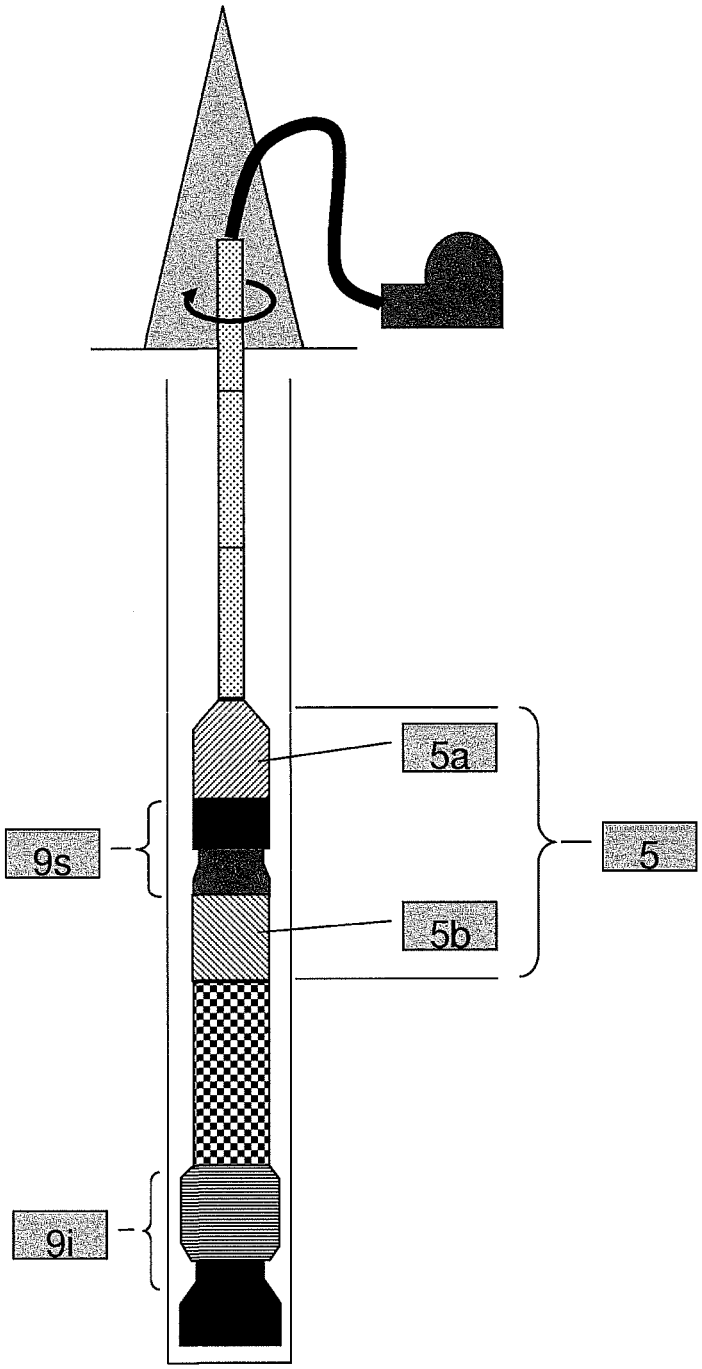
Figure 4:
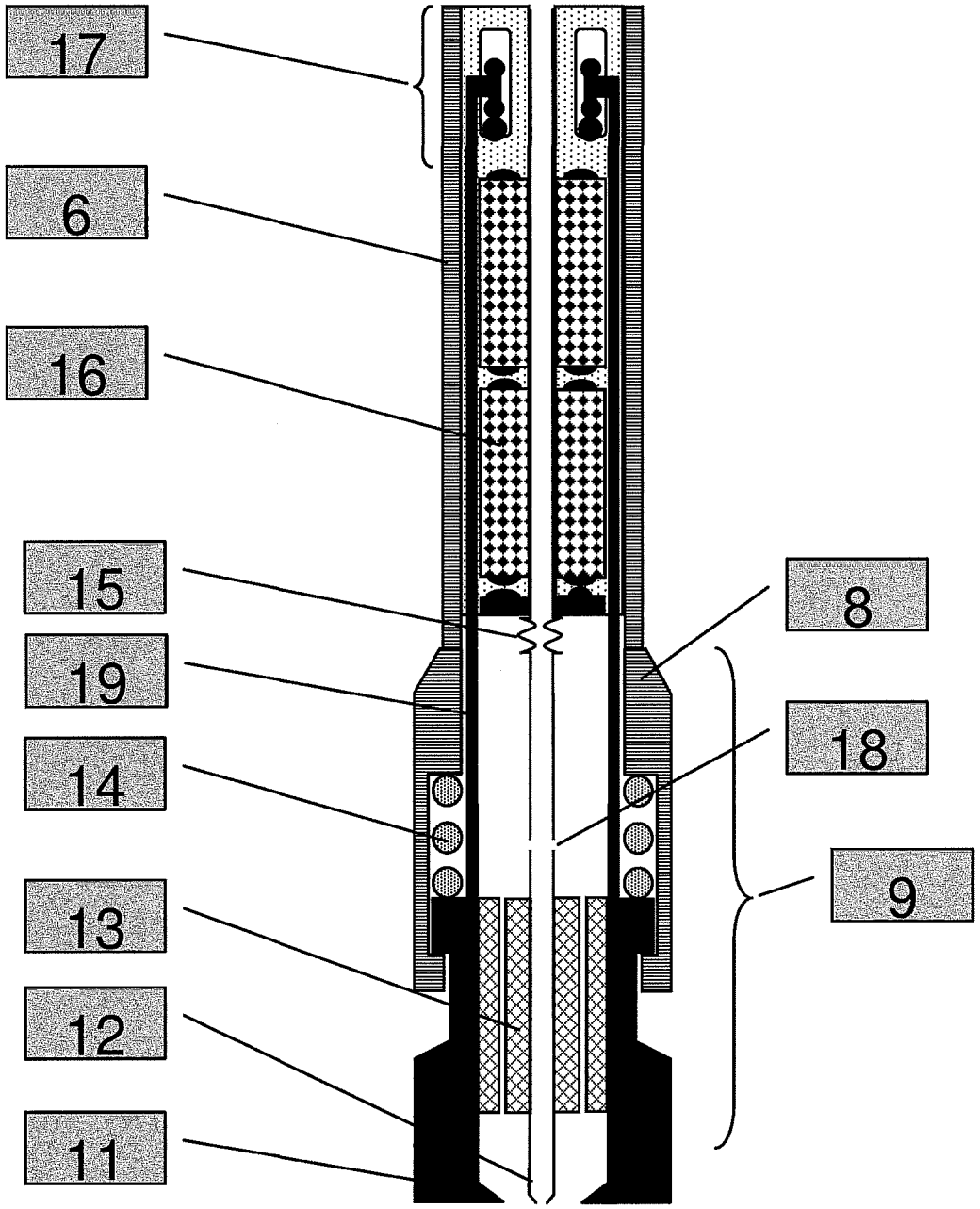
Figure 5:
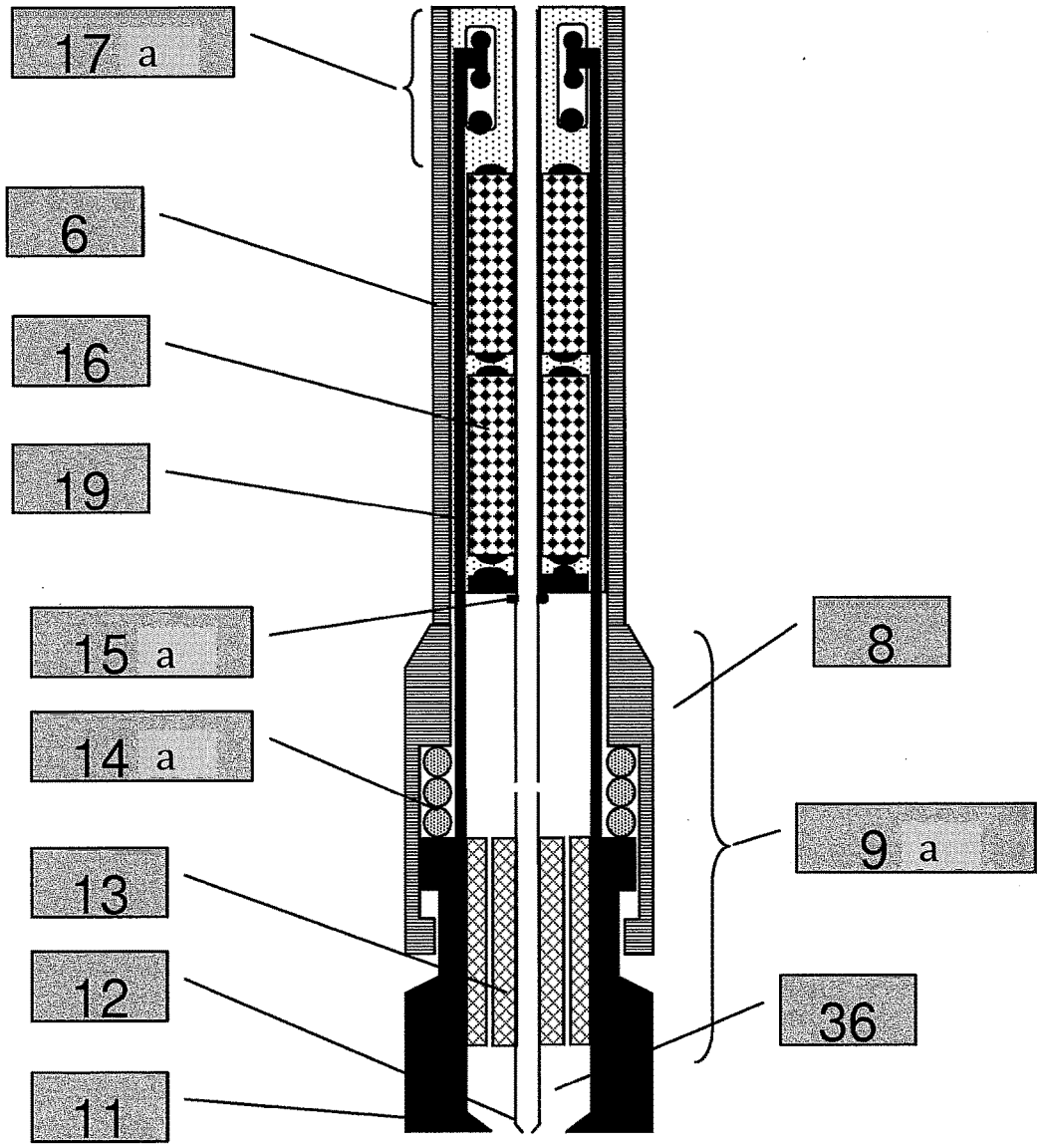
Figure 6:
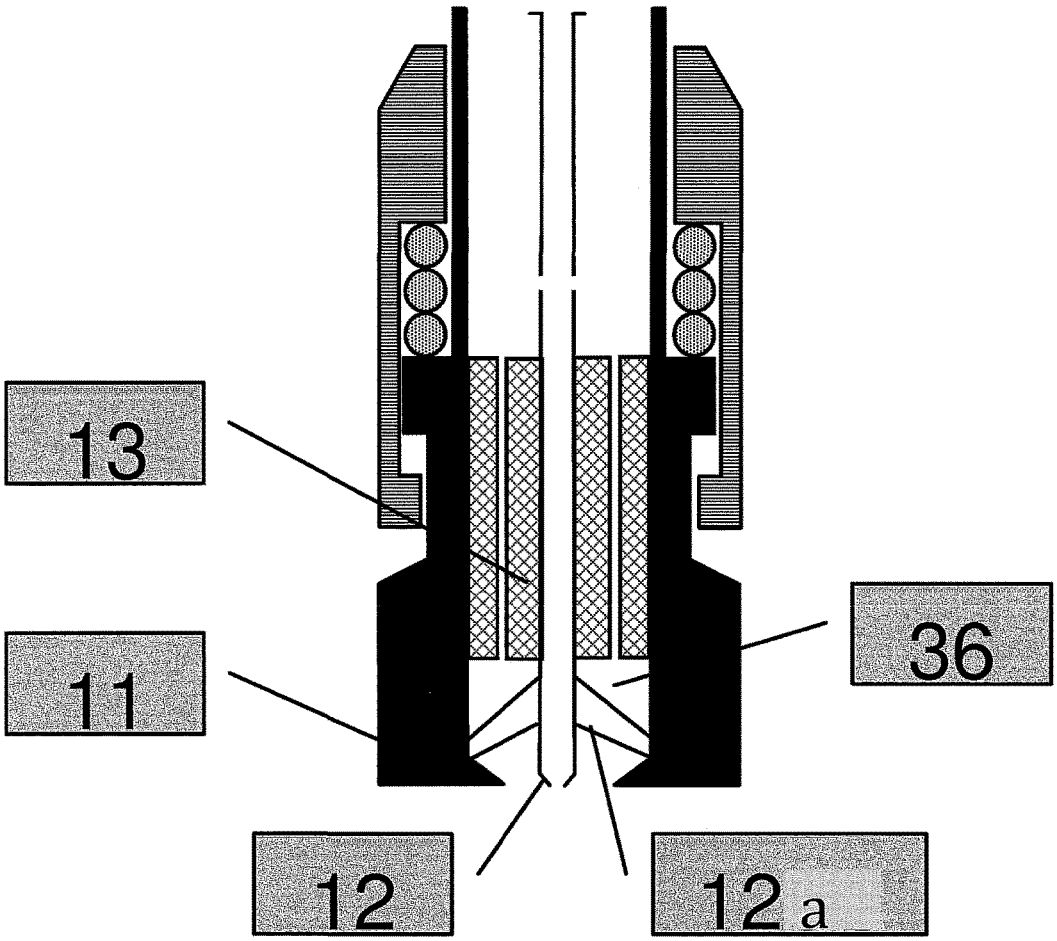
Figure 7:
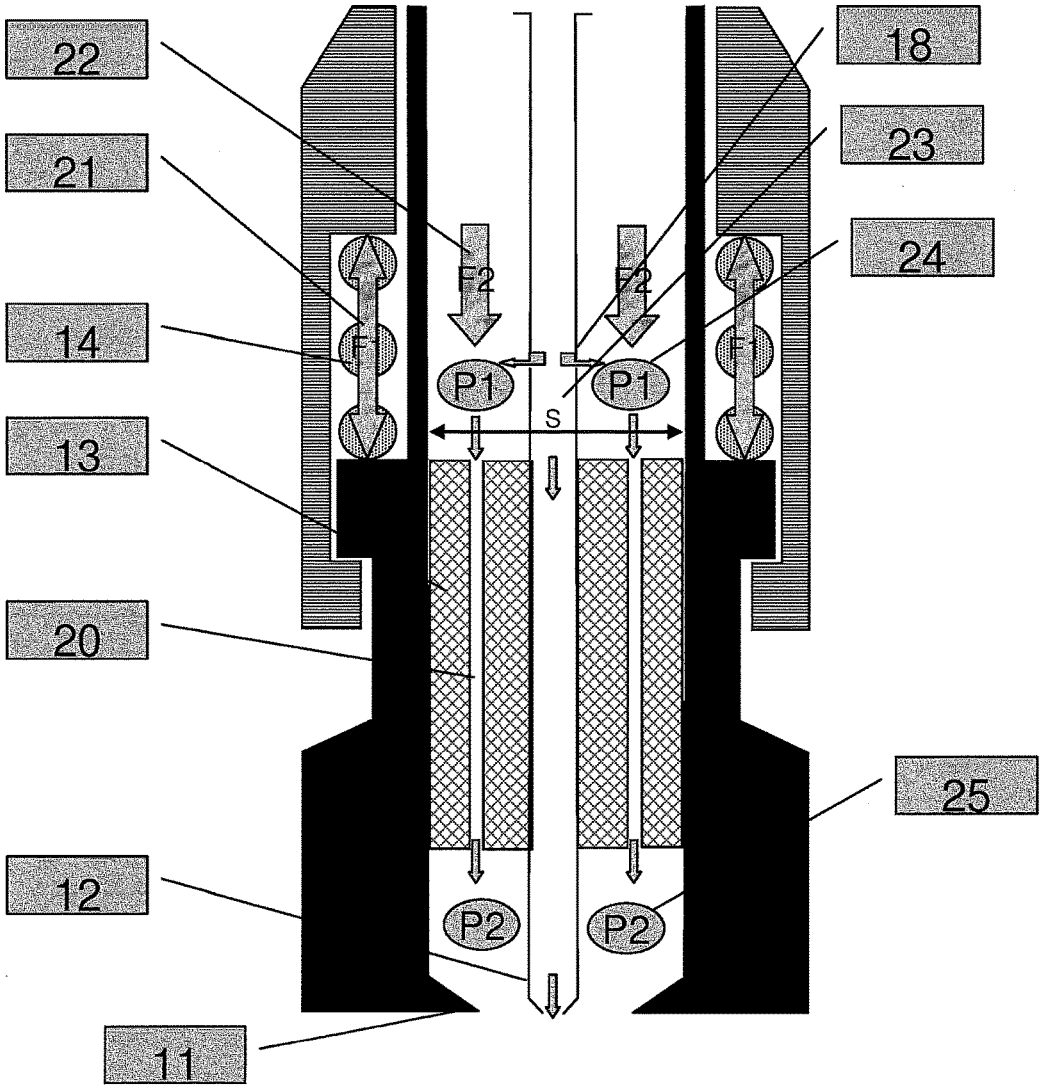

FIG. 3 represents an overall system in "two sliding electrical switches" configuration. In this:

- 9*s*: upper electrical slide switch
- 9*i*: lower electrical slide switch
- 5*a*: hydraulic compartment
- 5*b*: electrical compartment
- 5: electricity generator FIG. 4 represents a pulse generator and electric drilling tool in "open slider" configuration—"Slider positioned at the level of the electrical drilling tool" configuration. In this:

- 6: pulse generator
- 8: stabiliser
- 9: slider switch in "normally open" position
- 11: grounding electrodes
- 12: central or offset high voltage electrode
- 13: insulator
- 14: spring in uncompressed position
- 15: bellows spring in extended position
- 16: capacitor
- 17: system for opening/closing capacitor charge circuit and for discharging capacitors over a resistor in "normally off" configuration
- 18: orifices for circulation of drilling fluid
- 19: system for mechanical transmission FIG. 5 represents a pulse generator and electric drilling tool in "closed slider" configuration—"Slider positioned at the level of the electrical drilling tool" configuration. In this:

- 6: pulse generator
- 8: stabiliser
- 9*a*: slider switch in "closed" position
- 11: grounding electrodes
- 12: central or offset high voltage electrode
- 13: insulator
- 14*a*: spring in compressed position
- 15*a*: bellows spring in compressed position
- 16: capacitor
- 17*a*: system for opening/closing capacitor charge circuit and for discharging capacitors over a resistor in "activated" configuration
- 18: orifices for circulation of drilling fluid
- 19: system for mechanical transmission
- 36: high voltage chamber FIG. 6 represents an electric drilling tool, equipped with an electrical slide switch, in "high voltage electrodes comprising a central or offset electrode and several peripheral electrodes" configuration. In this:

- 11: grounding electrodes
- 12: central or offset high voltage electrode
- 12*a*: high voltage peripheral electrodes
- 13: insulator
- 36: high voltage chamber FIG. 7 represents a detail of operation of the mechanical and hydraulic part of the electrical slide switch when positioned at the level of the electric drilling tool. In this, in addition to the references already given for FIGS. 4 and 5:

- 20: drilling fluid circulation channels
- 21: force F1 exerted by spring 14 opening the slider
- 22: force F2 resulting from the pressure created by the losses of load [P2 (24)-P1(25)] of the fluid in the insulator channels (20) and the section S (23) on which this pressure applies
- 23: surface on which the pressure is exerted which results from the losses of load [P2 (24)-P1 (25)] of the fluid in the insulator channels (20)
- 24: pressure P1 of the drilling fluid upstream of the insulator channels (20)
- 25: pressure P2 of the drilling fluid downstream of the insulator channels (20)

Figure 8:
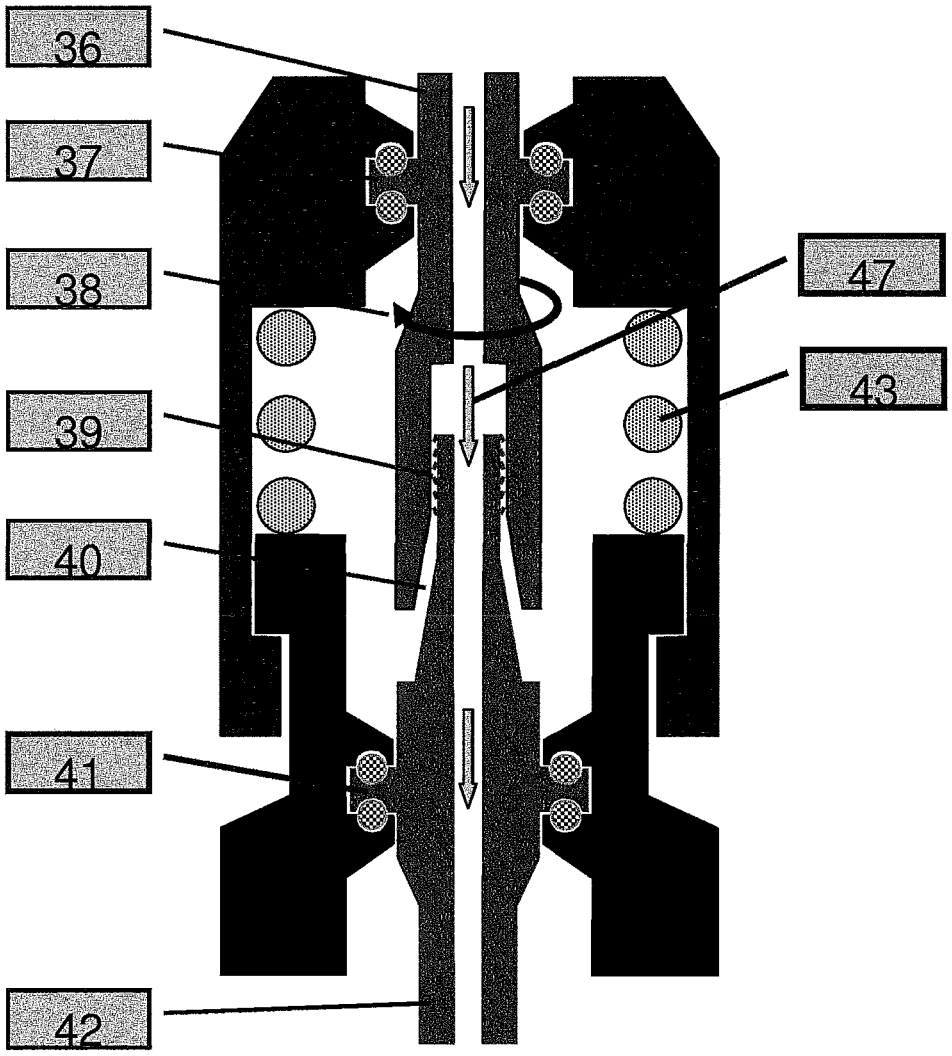
Figure 9:
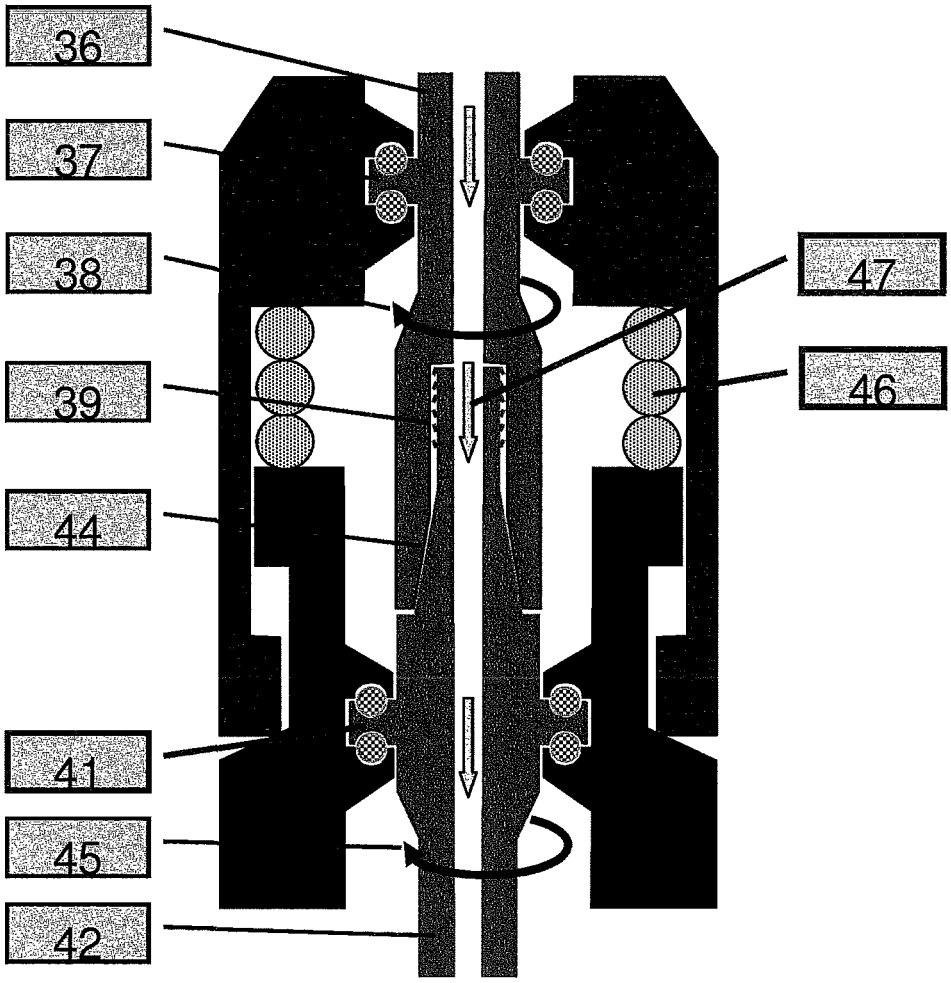
Figure 10:
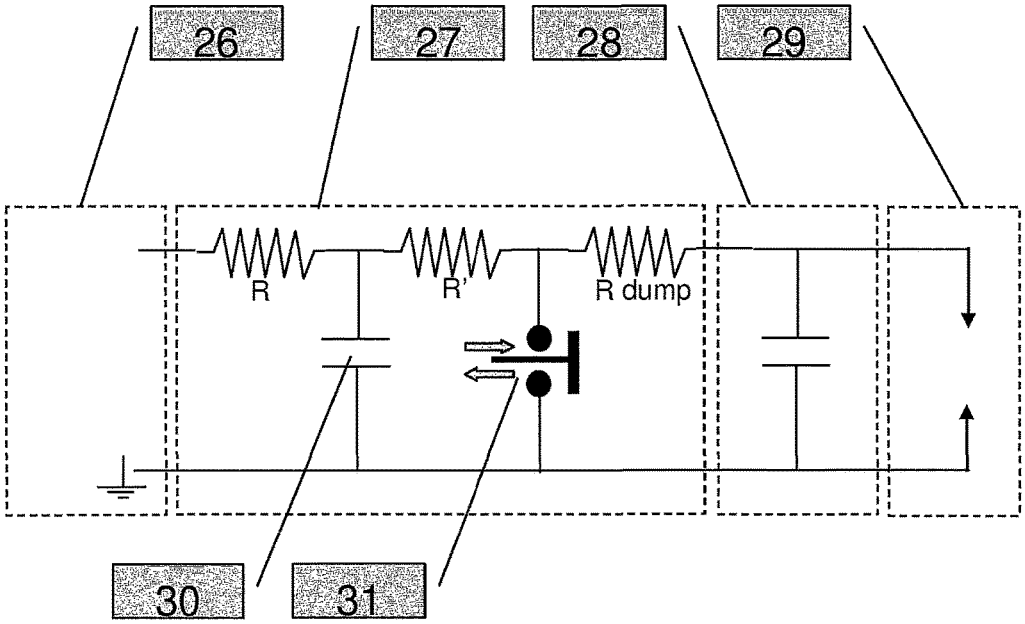
Figure 11:
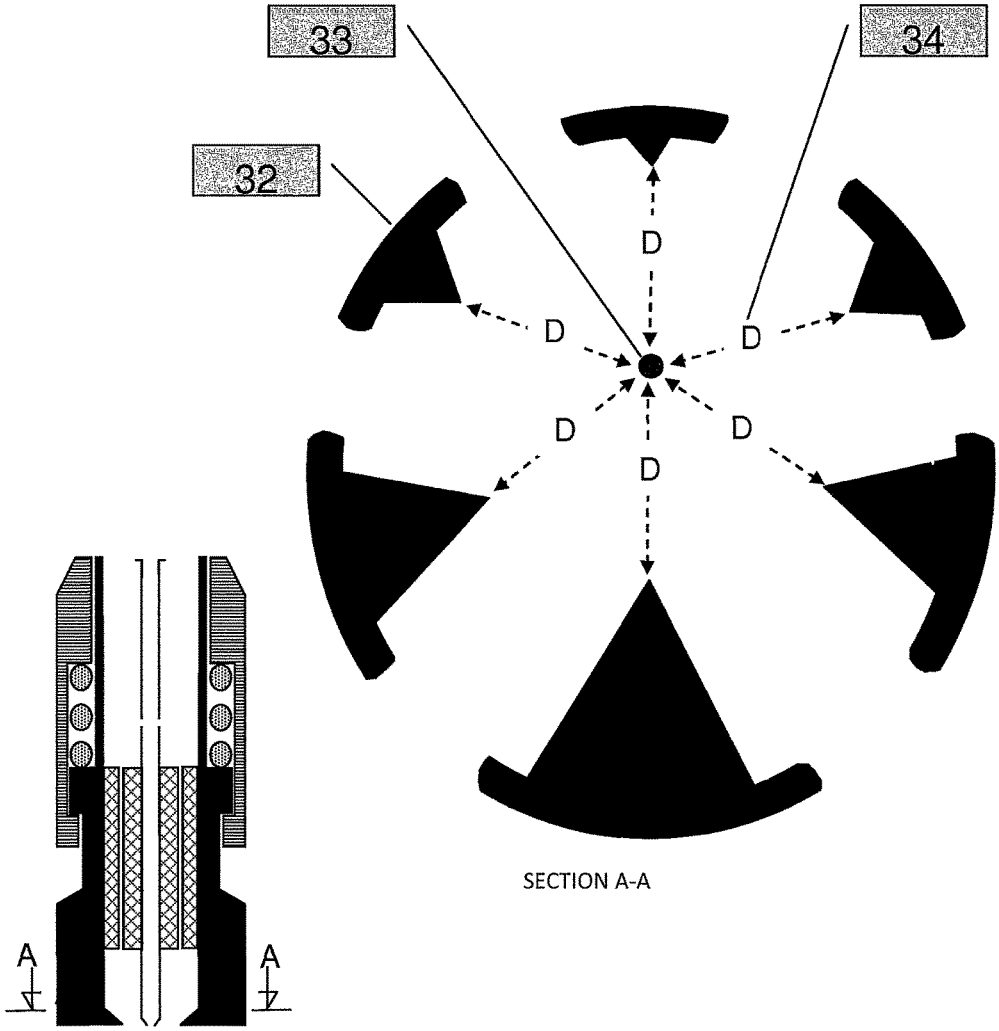
Figure 12:
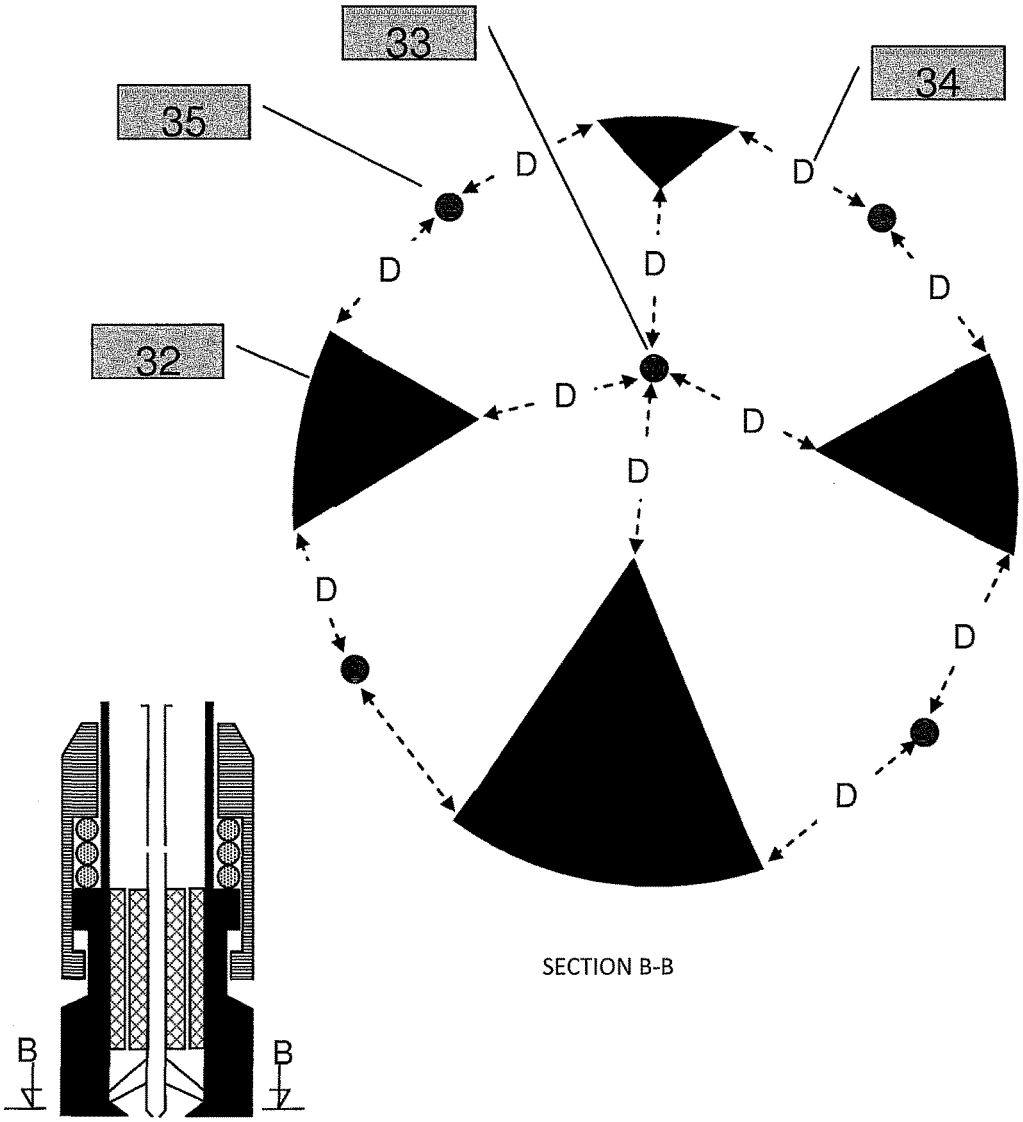
Figure 13:
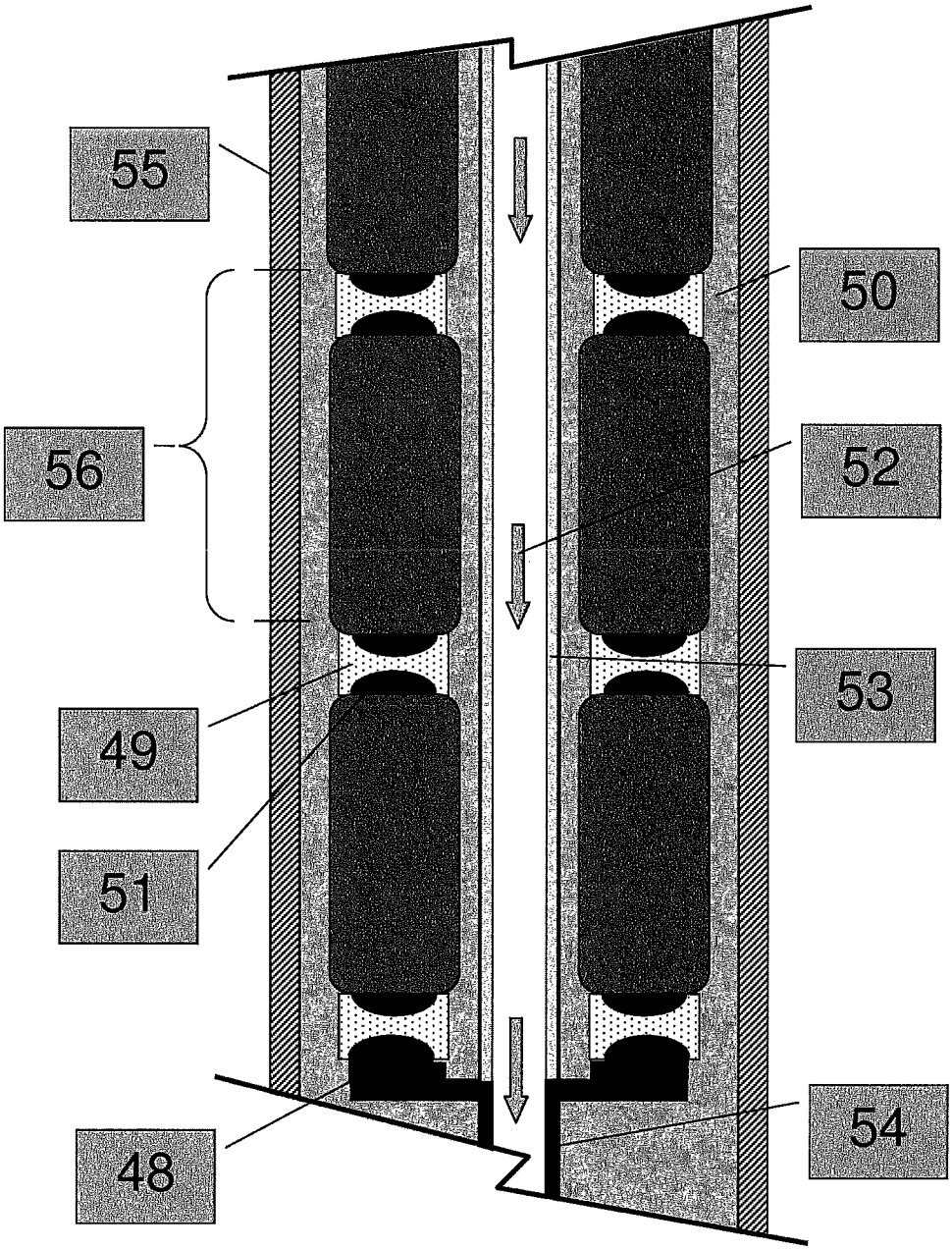

FIG. 8 represents an electrical slide switch positioned between the hydraulic compartment and the electrical compartment of the electricity generator—disengaged position. In this:

36: upper hollow driven shaft connected to the hydraulic compartment rotor (turbine or downhole motor)
37: upper bearing
38: rotary movement of the hollow shaft driven by the hydraulic compartment rotor (turbine or downhole motor) of the electricity generator
39: seals
40: mechanism for mechanical connection between the upper part and the lower part of the hollow shaft in the disengaged position
41: lower bearing
42: lower hollow shaft connected to the electrical compartment rotor (alternator) of the electricity generator
43: spring in uncompressed position
47: drilling fluid circulation FIG. 9 represents an electrical slide switch positioned between the hydraulic compartment and the electrical compartment of the electricity generator—engaged position. In this:

36: upper hollow driven shaft connected to the hydraulic compartment rotor (turbine or downhole motor)
37: upper bearing
38: rotary movement of the hollow shaft driven by the hydraulic compartment rotor (turbine or downhole motor) of the electricity generator
39: seals
41: lower bearing
42: lower hollow shaft connected to the electrical compartment rotor (alternator) of the electricity generator
44: mechanism for mechanical connection between the upper part and the lower part of the hollow shaft in the engaged position
45: rotary movement of the lower hollow shaft driven by the upper hollow shaft
46: spring in compressed position
47: drilling fluid circulation FIG. 10 represents a detail of the operation of a part of the circuit for discharging capacitors over resistors from the electrical slide switch. In this:

26: electricity generator
27: circuit for discharging capacitors over resistance
28: pulse generator
29: electric drilling tool
30: decoupling capacitor
31: contactor actuated by the mechanical transmission system FIG. 11 represents an example of a configuration of the electrode system with a high voltage device comprising a single central offset electrode. In this:

32: grounding electrode
33: central offset high voltage electrode
34: distance D between the points of the grounding electrodes and the central electrode FIG. 12 represents an example of a configuration of the electrode system with a high voltage device comprising a central offset electrode and peripheral electrodes. In this:

32: grounding electrode
33: central offset high voltage electrode
34: distance D between the points of the grounding electrodes and the central electrode
35: peripheral high voltage electrode FIG. 13 represents a cross section of the pulse generator—Marx configuration generator with annular gas discharge tubes. In this:

48: electrical interface between the pulse generator and the hollow axial high voltage tube
49: annular electrodes gas discharge tube
50: insulator
51: gas discharge tube annular electrode
52: drilling fluid circulation
53: hollow axial tube in insulating material
54: hollow axial high voltage tube
55: external metal shell
56: comprising an energy storage device (capacitor) and a power switch (gas discharge tube)

Figure 14:
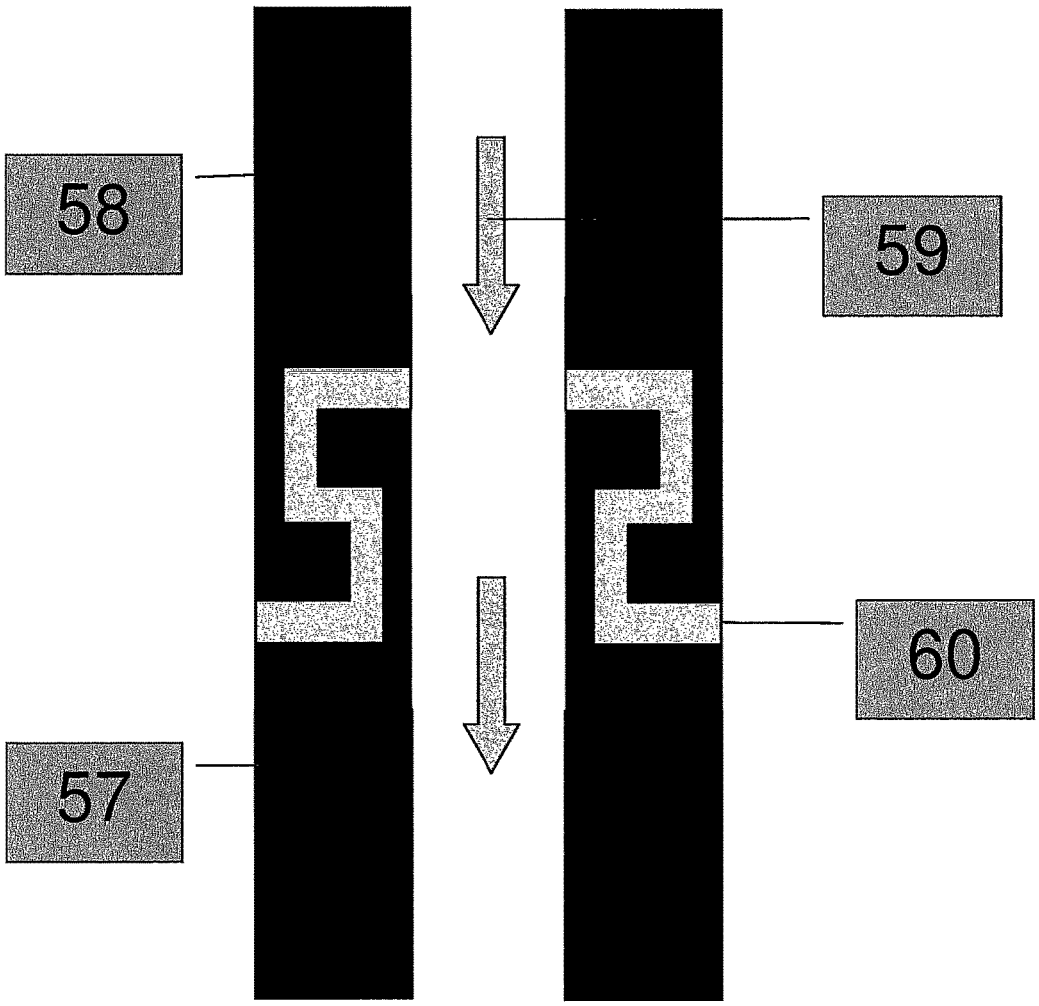
Figure 15:
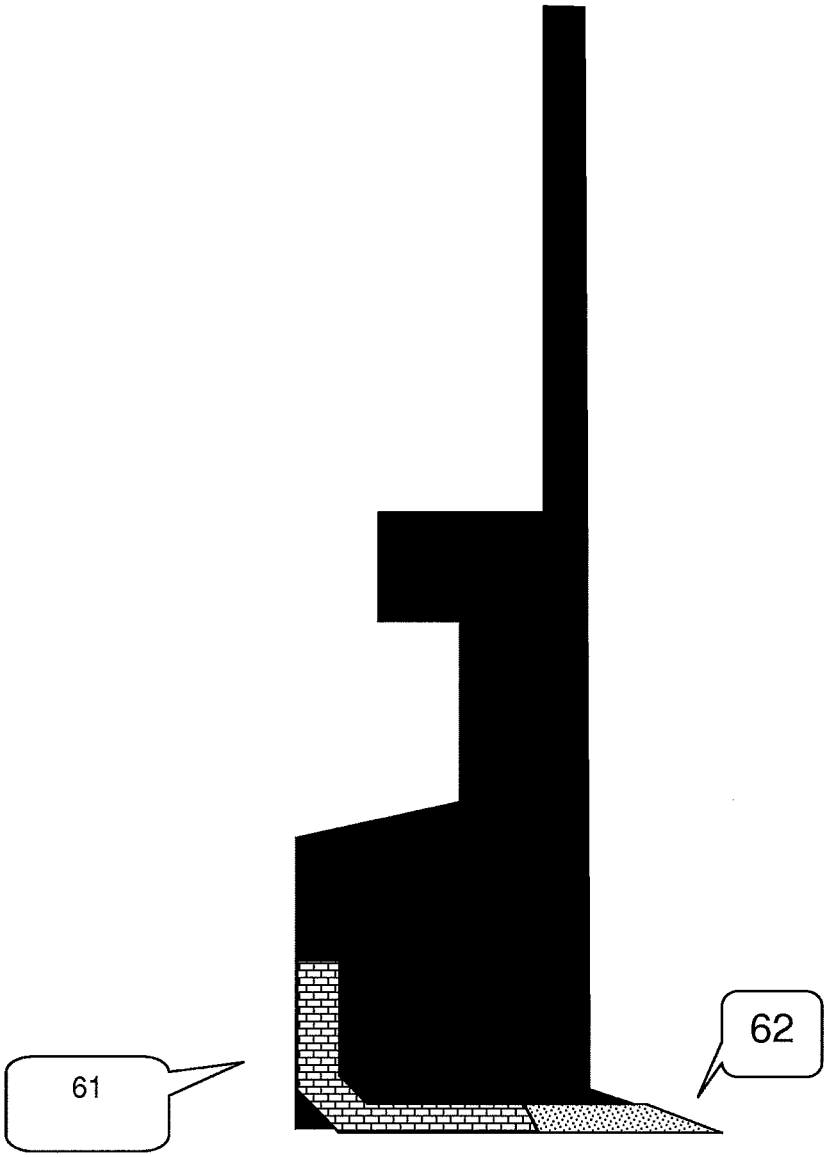

FIG. 14 represents an insulating connector. In this:

57: lower metal part
58: upper metal part
59: flow of drilling fluid
60: insulator FIG. 15 represents a view of a part of an electrode. In this:

61: PDC
62: impregnated matrix

Figure 16:
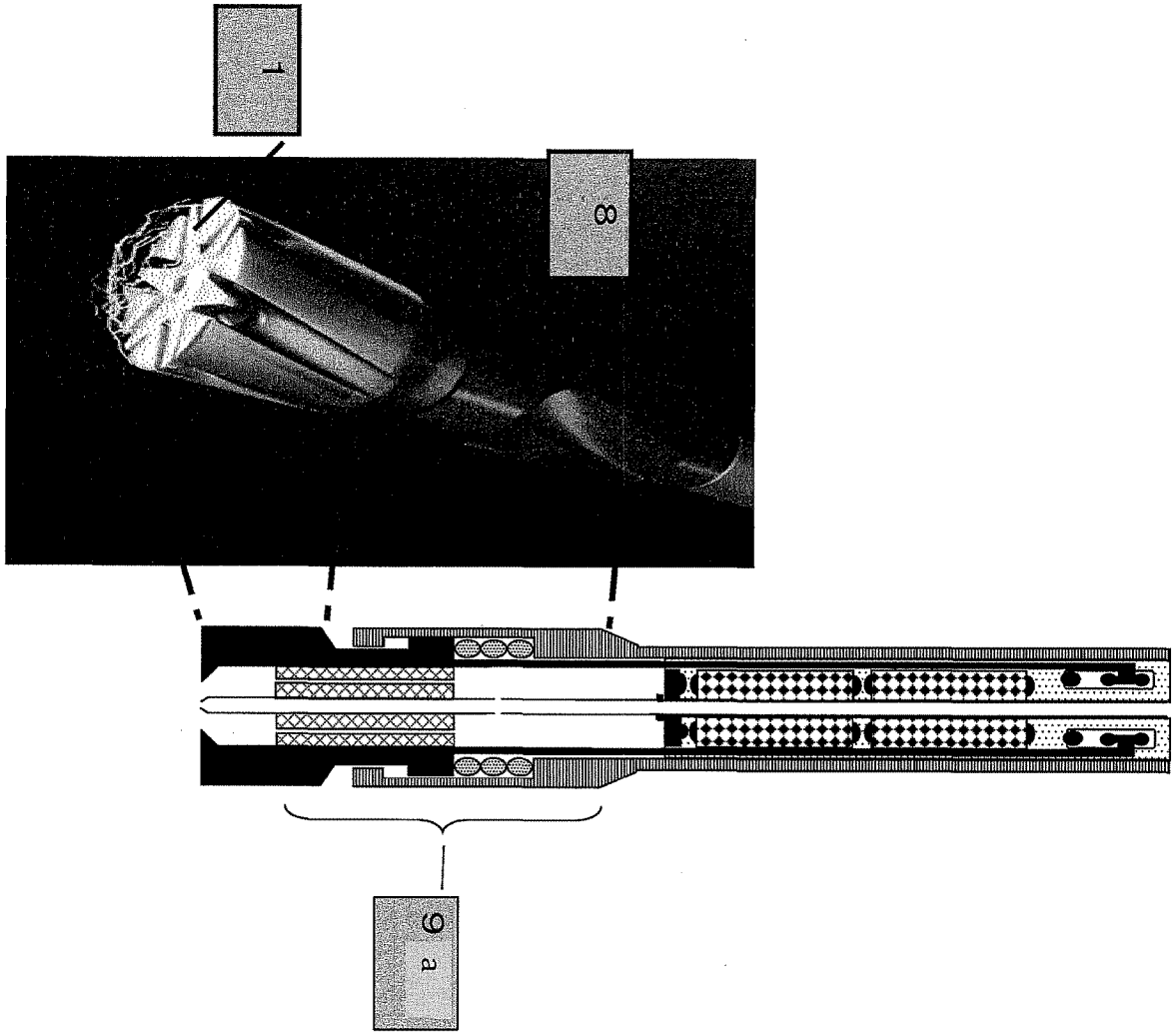

FIG. 16 represents a three-dimensional view of a tool according to the invention.

DESCRIPTION OF EMBODIMENTS OF THE INVENTION

The invention is now described in more detail and in a non-limiting manner in the following description.

The invention can potentially be used in the following fields:

oil sector (exploration and development of oil and/or gas deposits),
mining sector (exploration drilling),
geothermal sector (drilling of low or high enthalpy wells),
civil engineering sector (geological assessment drilling, freeze-hole drilling, etc.).

The downhole equipment presented is incorporated at the end of a standard drill string (an assembly of drill pipes and/or drill collars) requiring no special arrangement. It consists of the following elements:

an electricity generator (5),
a pulse generator (6),
an electrical slide switch (9),
an electric drilling tool (7).

Associated with this downhole equipment is a drilling rig equipped with a derrick, mast or any other handling system (1), a system for rotating the drill string (2) and pumps for injecting the drilling fluid under high flow and high pressure (3), as well as a string of drill pipes and/or drill collars (4). A stabiliser (8) of standard design may be provided.

In parallel with implementation of the electrical process, the drill string may be rotated conventionally from the surface (with a rotary table and kelly drive or "power swivel") since no cable or other system for transmission of electrical energy interferes with this movement. Thus, the driller has a system fully compatible with the drill rig and standard procedures, while providing control of the electrical operation of the downhole system through the sliding of the tool.

In FIG. 1, the electrical slide switch is positioned at the electric drilling tool, while in FIG. 2 it is positioned between the electricity generator and the pulse generator.

The electrical slide switch may therefore be positioned at the electric drilling tool or at the interfaces between the different components of the system.

FIG. 3 also presents a configuration in which two sliding electric switches are used: one at the electricity generator and the other at the electric drilling tool.

The downhole equipment is used in conformity with standard drilling procedures and does not require any special arrangement of the drilling rig.

The various components of the device and the procedure according to the invention are described below.

The function of the electricity generator (5) is to convert the hydraulic energy of the drilling fluid into electrical energy. In one of the different configurations considered (with reference for example to FIG. 3), the electricity generator consists of the following components:

- a hydraulic compartment (5*a*) of downhole turbine or hydraulic motor type comprising a stator part and a rotor part,
- a mechanical interface providing transmission of the rotary movement from the rotor of the hydraulic compartment to the rotor of the electrical compartment,
- an electrical compartment (5*b*) which in a potential configuration is itself subdivided into two parts:
  - an alternator compartment comprising a stator part which carries the windings of the alternator and a rotor part which carries the magnetic components,
  - a charger which delivers a high voltage current of, for example, 1 kV to 50 kV, preferably between 20 kV and 40 kV, to supply the capacitors of the pulse generator.

In this configuration, the drilling fluid circulates between the stator part and the rotor part of the hydraulic compartment and rotates the rotor. This in turn drives the alternator rotor. At the interface between the hydraulic compartment and the electrical compartment, the drilling fluid penetrates inside the alternator rotor which consists of a hollow shaft with openings in the upper part. The low voltage electric current produced by the alternator supplies the high voltage charger which in turn supplies the capacitors of the pulse generator.

The power of the drilling fluid injected by the drilling rig pumps located at the surface drives the electricity generator. Thus, the design of the invention eliminates the need of any electric energy transmission system between the surface and the bottom, such as electrical cable, conductive drill pipes, coiled tubing or any other system. Production of electrical energy at the bottom thus eliminates a fundamental obstacle to the use of a drilling system by electrical discharge as presented in the various documents of the state of the art. This design renders the rotary drilling system by electrical discharge of this invention entirely compatible with standard drilling procedures, unlike the documents of the state of the art. It allows improvement of the effectiveness of the process of destruction of the rock by combining the mechanical effect brought by rotation and the effect of electrical discharges. It allows for manoeuvring of the drill string (raising to the surfaces and lowering to the bottom) in the conventional manner without the handicap of a cable attached to or in the drill pipes. The continuous rotary movement of the drill string also prevents the classically feared phenomena of sticking by differential pressure and reduces the risk of having to abandon the drill string in the hole.

The invention allows the device to be controlled from the surface. Without the additional device of the invention, the driller would be unable to permit or prohibit, from the surface, the electrical operation of the rotary drilling system by electrical discharge. Indeed, only controlling the circulation of mud by the pumps allows starting or stopping operation of the system. However, it is well known in the drilling art that when a drill string is present in the hole, continuous circulation of mud is a vital necessity both in respect of the safety of the hole and in respect of the safety of the personnel, even if the drilling tool is not strictly drilling. This continuous circulation prevents risks of gas or oil blowout for Oil and Gas sector wells and avoids any sedimentation of rock debris (cuttings) thus preventing risks of drill string jamming Under these conditions, using only the electricity generator, without the device according to the invention, would impose continuous electrical operation of the rotary drill system by electric discharge whenever circulation of the mud is active. Such a rationale would be seriously detrimental to the safety of personnel, safety of the drilling and efficiency of the process.

With respect to safety of personnel, it is essential to ensure that electrical operation of the system is stopped and the capacitors discharged when raising the drill string to the surface. It is also desirable, when the drill string is under fluid circulation at the "boot" (end) of metal tubing (metal casing) to stop the system's electrical operation. The invention allows this object to be achieved, by the use of the sliding switch.

In terms of performance, it is important that the system has a life span as long as possible. This reason therefore recommends only triggering the rotary drilling system by electric discharge from the time when the drill string is at the bottom of the hole, that is, when the system is used for drilling. The invention also permits this object to be achieved, by the use of a sliding switch which will only activate the device at the bottom of the hole if desired.

Finally, it is preferable to be able to periodically stop the electrical operation of the system during "mud pulse" transmission from a MWD to avoid interference between the systems. The invention also allows this object to be achieved, through the use of the sliding switch.

All these examples (non-exhaustive list) clearly demonstrate that it is desirable to have a means of remote control of the electrical operation of the rotary drilling system by electric discharge and all to hand. This control from the surface is made possible through incorporation of an electrical slide switch (9) positioned at various potential locations in the system's architecture (this switch is described further below).

In a preferred configuration, this electrical slide switch is located at the interface between the hydraulic compartment and the electrical compartment (ref. FIG. 3). This switch plays the role of a mechanical clutch. The "normal" position of this switch prevents mechanical locking of the rotor of the hydraulic compartment with that of the electrical compartment. It provides a guarantee of the fact that the system cannot operate unless the driller so decides. The decision by the driller to operate the system consists of applying a significant weight to the tool of several tons, for example between 2 t and 15 t, placing a part of the drill string in compression. When the driller applies this force, the switch slider closes, mechanical locking is established between the rotors of the hydraulic and electrical compartments and the electricity generator then produces electric current.

In one of the configurations considered, this electrical slide switch enables actuation of a system for opening/closing of high voltage power to the capacitors.

The "normal" position of this switch prevents high voltage electricity supply to the capacitors. It provides a guarantee of the fact that the system cannot operate unless the driller so decides. The decision by the driller to operate the system consists of applying a significant weight to the tool of several tons placing a part of the drill string in compression. When the driller applies this force, the slider of the switch closes, an electrical contact is established and the system can then operate.

In another configuration considered, this electrical slide switch allows actuation of a mechanical locking system between the hydraulic system rotor and the alternator rotor (see FIGS. 8 and 9 below). The "normal" position of this switch prevents the alternator rotor from turning. In this position, no electric current can therefore be produced. As in the previous case, it provides a guarantee of the fact that the system cannot operate unless the driller so decides. The decision by the driller to operate the system consists of applying, with the same rationale as that described above, a significant weight to the tool of several tons placing a part of the drill string in compression. When the driller applies this force, the slider of the switch closes, the hydraulic compartment rotor engages the alternator rotor and the system can then operate.

In another preferred embodiment, the system is equipped with two electrical slide switches (as shown in FIG. 3):

- an upper electrical slide switch (9*s*) between the hydraulic compartment and the electrical compartment of the electricity generator,
- a lower electrical slide switch (9*i*) at the electric drilling tool.

Thus in this configuration, the system is provided with double security. The upper switch in the normal position guarantees that the production from the electricity generator is stopped and that no current powers the system, even if circulation of the drilling fluid is maintained. The lower switch in normal position guarantees that the pulse generator capacitors are discharged and cannot be recharged.

Thus the electrical slide switch according to the invention, as well as the downhole electricity generator gives the system for rotary drilling by electrical discharge the reliability, safety and performance required by drilling rules particularly in the oil sector.

FIGS. 4 and 5 represent a pulse generator and a drilling tool (slide positioned at the electric drilling tool), in slide open and slide closed position respectively. In these, the pulse generator (6) is connected to the stabiliser (8), integral in the slide switch (9). The device comprises grounding electrodes (11) and a single central or offset high voltage electrode (12) or a plurality of high voltage electrodes, between which there is an insulator (13). These electrodes, which at their end part at the high voltage chamber (36) are not separated by any solid material, deliver the electrical pulses necessary for drilling. The device also includes orifices for circulation of drilling fluid (18) and a system for mechanical transmission (19), as well as capacitor (16) banks.

In the open position in FIG. 4, a spring can be seen in the uncompressed position (14), a bellows spring in the extended position (15), a circuit opening/closing system (17) for the capacitor charging and discharging over resistor circuit, in the "normally off" configuration.

In the closed position in FIG. 5, the switch (9*a*) is shown in the closed position and the spring in the compressed (14*a*) position, the bellows spring in compressed position (15*a*) and the system (17*a*) for opening/closing of the circuit for charging the capacitors and discharging the capacitors over the resistor (capacitor dump) in "actuated" configuration. In this configuration of FIG. 5, the circuit for high voltage power supply of the pulse generator is therefore closed and the capacitors can be charged. Details of the operation of the opening/closing of the high voltage power supply circuit of the capacitors and their discharge is illustrated in FIG. 10, in which the electricity generator (26) is connected to the (27) for discharging the capacitors over the "dump" resistor, said discharge circuit also including a decoupling capacitor (30) and a contactor (31) actuated by the mechanical transmission system, this circuit being connected to the pulse generator (28), itself being connected to the drilling tool (31).

FIG. 7 shows a detail of operation of the mechanical and hydraulic part of the sliding switch (slide positioned at the electric drilling tool), in slider opened and slider closed configuration, respectively. In this FIG. 7 are again shown the grounding electrodes (11), central or offset high voltage electrodes (12), the insulator (13), and spring in uncompressed position (14) and the orifices for circulation of the drilling fluid (18). Shown furthermore are the drilling fluid circulation channels (20) in the insulator (13), as well as the following forces and pressures:

- 21: force F1 exerted by spring 14 opening the slider
- 22: force F2 resulting from the pressure created by the losses of load [P2 (24)-P1(25)] of the fluid in the insulator channels (20) and the section S (23) on which this pressure applies
- 23: surface on which the pressure is exerted which results from the losses of load [P2 (24)-P1 (25)] of the fluid in the insulator channels (20)
- 24: pressure P1 of the drilling fluid upstream of the insulator channels (20)
- 25: pressure P2 of the drilling fluid downstream of the insulator channels (20).

In order to reinforce the passive action of the slider spring, the vertical channels in the insulator are dimensioned to create a loss of load ($\Delta P = P1 - P2$) which translates by a vertical force F2 directed downward from the top equal to the product of this load loss times the area of the lower sliding part ($F2 = \Delta P \times S$). Thus, this force reinforces force F1 of the spring and of the suspended weight under the slider.

Thus, when the electric drilling tool is not resting on the bottom of the hole and drilling fluid is circulating, the driller not only has the certainty that the capacitors are no longer powered but also that they are fully discharged. Indeed, the electrical slide switch, in the normally open position, opens the capacitor charging circuit and also closes the circuit for discharging the capacitors over the "dump" resistor (see FIG. 10). When the tool is resting on the bottom of the hole and a weight greater than the cumulative forces of the spring and the load losses is applied to the tool, the slider closes and the transmission rod actuates the circuit closing/opening system. At this instant, the capacitor charging circuit is closed, that capacitors are no longer connected to the system for discharging the capacitors over the "dump" resistor, and rotary drilling by electrical discharge can then operate.

FIG. 6 is a representation in which can be seen the grounding electrodes (11), the central or offset high voltage electrode (12), the peripheral high voltage electrodes (12*a*), the insulator (13) and the high voltage chamber (36) defined between the electrodes.

As described above, the electrical slide switch provides the following three functions:

- passively prohibits, in a "normally prohibited" type rationale, rotation of the alternator rotor, and/or electric power to the high voltage charger by the alternator and/or the capacitor power supply circuit of the pulse generator,
- passively ensure closing of the circuit for discharge of the capacitors over a "dump" resistor in a "normally discharged" type rationale,
- permit, upon positive action triggered by the driller from the surface:

rotation of the alternator rotor, and/or
electric power to the high voltage charger by the alternator, and/or
power to the pulse generator capacitors, and
jointly opening the circuit for discharging the pulse generator capacitors over resistor (ref. FIG. 10).

Thus, the "normally prohibited" or "normally open" position of this switch is the secure position which guarantees the absence of high voltage risk and electrical non-operation of the system for rotary drilling by electrical discharge.

In one embodiment, this switch consists of a slider incorporated between the hydraulic compartment (turbine or downhole motor) and the electrical compartment (alternator) of the electricity generator (as shown in FIGS. 3, 7 and 8). The slider consists of two parts sliding on each other with a high stop and a low stop enabling a travel of several centimeters to several decimeters, for example, from 1 cm to 20 cm. This slider is designed with a "normally open" type rationale through the action of a mechanical spring of robust constitution, which exerts a powerful separating force between the two sliding parts. The weight suspended under the lower part of the slider reinforces the action of the spring which maintains the slider in the open position. The upper part of the slider carries a hollow shaft (connected to the rotor of the hydraulic compartment) mounted on bearings to disconnect the rotary movements between the slider and this shaft. The lower part of the slider also carries a hollow shaft (connected to the rotor of the electrical compartment) mounted on bearings to disconnect the rotary movements between the slider and this shaft. The upper and lower hollow shafts are equipped with a clutch system. One of the shafts also has seals to ensure continuity of drilling fluid flow regardless of the relative position of the two shafts. When the slider is open, the fluid circulates freely from the stator/rotor space of the hydraulic compartment to the interior of the electrical compartment rotor (alternator) and beyond to the electric drilling tool but the two rotors are not mechanically locked. Thus, notwithstanding the ongoing circulation of the drilling fluid, the electricity generator does not produce any current since the alternator rotor is not turning. When the slider closes, the clutch system unites the two rotors and thereby permits rotation of the alternator rotor. Closing of the slider is only possible when the driller compresses a part of the drill string and applies a weight on the tool greater than the spring opening force. From this moment, the system for rotary drilling by electrical discharge can then operate.

FIGS. 8 and 9 represent a detail of the slider switch (slider positioned between the hydraulic compartment and the electrical compartment of the electricity generator) in the clutch disengaged and engaged position, respectively.

Shown is the driven upper hollow shaft (36) connected to the hydraulic compartment rotor (turbine or downhole motor) of the electricity generator, the rotary movement being identified by the arrow (38). Circulation of the drilling fluid is identified by the arrow (47). This shaft is held in an upper bearing (37).

Also shown is the lower hollow shaft (42) connected to the electrical compartment rotor (alternator) of the electricity generator, without rotation. This shaft is held in a lower bearing (41). A seal (39) is present at the connection between the upper (36) and lower (42) shafts. The spring (43) is in the uncompressed position, holding the two shafts apart.

In FIG. 9, the position is engaged and in this position the spring is in the compressed position (46) and a mechanical connection mechanism (44) is created between the upper and lower part of the hollow shaft in the engaged position, which leads to rotary movement of the lower hollow shaft driven by the upper hollow shaft, identified by the arrow (45), the mechanical connection being thus ensured.

As described with reference to the figures and particularly FIG. 6, the electrical slide switch consists of three parts:
a mechanical slider,
a mechanical transmission system,
a circuit opening/closing system.

The slide switch system can be incorporated (i) at the said electric drilling tool, or (ii) at the interface between the said electrical drilling tool and the said pulse generator, or (iii) at the said pulse generator, or (iv) between the said pulse generator and the said electricity generator, or (v) at the said electricity generator, or (vi) above the said electricity generator.

The slider is generally joined to a mechanical transmission system which actuates the circuit opening/closing system. In one embodiment, this system consists of one or more rods which slide in a housing formed in the thickness of the exterior metal body of the pulse generator and/or the electricity generator depending on the position of the slider in the system's architecture.

The circuit opening/closing systems actuated by the slider are particularly related to the following circuits:
the circuit for supplying the high voltage charger of the electricity generator; and/or
the capacitor power circuit from the pulse generator; and/or
the circuit for discharging the capacitors over a resistor.

In one embodiment, the slider is positioned at the electric drilling tool. In this configuration, the lower sliding part consists of the following components:
the body which carries the grounding electrodes,
the insulator,
the system of high voltage electrodes.

The pulse generator is mechanically and electrically connected to the electricity generator. This is the component which creates and delivers very high voltage pulses to the electric drilling tool. It can be based on various architectures for raising from a primary voltage.

Three architectures for raising voltage are considered. The first is based on use of a Marx generator. The second is based on LTD (Linear Transformer Driver) technology. The third is based on the technology of Tesla transformers.

In the three cases, as shown in FIG. 13, the pulse generator is crossed in its axis by an axial hollow tube whose walls consist of an insulating material (53). This hollow tube provides for circulation of the drilling fluid (52). In the lower part of the pulse generator, this tube is mechanically connected to another hollow tube of the same diameter but whose walls are in steel (54). The steel tube receives the high voltage pulses and transmits them to the electrode system of the electric drilling tool.

Given the presence of the tube in the axial part, the preferred arrangement consists of arranging the components of the pulse generator in a ring pattern. In the case of using a Marx generator (an elementary V0 voltage adder using an arithmetic sequence with initially nil term and V0 reason), one configuration considered consists of stacking identical easily replaceable elementary modules (56) in the annulus between the hollow axial tube and the outer metal envelope. These modules are surrounded by an insulating material (53). Each module consists of an energy storage device (here capacitors) and a power switch. The capacity of a module can be between 20 nF and 1000 nF, preferably between 50 nF and 200 nF. The number of modules used determines the desired voltage range at the pulse generator output. The elementary voltage applied to the input of the pulse generator is provided by the high voltage charger of the electricity generator. It can be between 1 kV and 50 kV, preferably between 20 kV and 40 kV. Typically, the pulse generator output voltage can be between 200 kV and 1000 kV, preferably between 400 kV and 600 kV. The frequency of high voltage pulse production towards the electrode system of the drilling tool may be between 1 Hz and 100 Hz, preferably between 5 Hz and 50 Hz.

In one configuration considered, the power switch is a gas discharge tube (49). Its electrodes are full annular crowns (51). Electrical insulation of the power switch is provided by gas under pressure, retained or periodically renewed. The annular and contoured profile of the power switch electrodes allows the area that can be eroded on each electrode be increased, so as to extend their service life.

Electrical insulation between modules is provided by the use of interlocking insulators and compressed seals. The pulse generator output is connected to the electrode system of the drilling tool by an insulated interface whose insulating element may be solid, liquid or gaseous.

In one embodiment, the pulse generator has an upper part, under the interface with the electricity generator, with a system for opening/closing the circuit for charging and discharging the capacitors (as shown in FIGS. 3, 4 and 9). This system is actuated by a mechanical transmission system set in motion through the electrical slide switch which is normally open. Thus, without a deliberate action by the driller from the surface, this component guarantees that the electrical operation of the system for rotary drilling by electrical discharge is interrupted and that handling of the drill string with or without mud circulation can be done safely with respect of both personnel and material.

The electric drilling tool (see for example FIGS. 3, 4 and 5), in one embodiment, comprises:

a system of electrodes, passive and active, a body having a stabiliser of standard design.

The system of electrodes consists of two groups of electrodes separated by an insulator:

one or more high voltage electrodes (33 and 35), an insulator (13), grounding electrodes (11 and 32).

In one embodiment considered, the system of high voltage electrodes consists of a hollow central shaft connected to the capacitors. The insulator has vertical channels (20). The drilling fluid circulates inside the central shaft and follows two paths:

inside the central shaft to the end of this shaft, that is, to the bottom of the electric drilling tool, the vertical channels of the insulator (20) through perforations in the central shaft over the insulator (18).

The grounding electrodes are attached to the outer body of the electric drilling tool and consist of protuberances of robust constitution extending horizontally or inclined (32) designed to resist torque and weight on the tool allowing the use of the conventional rotation system. The insulator (13) which separates the system of high voltage electrodes from the system of grounding electrodes is a material of ceramic, epoxy or any other insulating component which is resistant to both the temperature and mechanical forces to which it is subjected to under drilling conditions.

A special feature of the electric drilling tool according to the invention resides in the arrangement of the electrodes with respect to the matrix of the tool. Indeed, documents of the prior art show securing of electrodes in a matrix, thereby inducing the presence of a solid material between the high voltage electrodes and the grounding electrodes, close to the end of the electrodes. Other documents of the prior art give no detail on this aspect. Indeed, a solid material, be it an insulator, risks being destroyed if it is present between the electrodes in a section where the high voltage component is too close to the grounding component. When drilling, although most of the electric arcs penetrate the rock, a small proportion may take a straight line between the electrodes. This tendency will be even stronger when there is not such a good physical contact between the rock and the electrodes. In addition, when the electric drilling tool is lifted off the bottom of the hole and assuming that the system continues to operate (which is not the case in this invention due to the electrical slide switches), all the electric arcs would take a straight line between the electrodes, thereby destroying the solid material present on the path. Thus, the rationale of constitution of the electrode systems presented in the prior art is not viable.

To address this problem, the terminal part of the electric drilling tool of this patent comprises an internal chamber free of any solid materials other than electrodes. This chamber is bounded upward by the lower part of the insulator and on the sides by the framework of the grounding part. The high voltage electrodes cross through this chamber. This design ensures that once the distance between the grounding part and the high voltage part decreases significantly below the value which separates these two parts at the insulator, any electric arc produced in this chamber will have no consequence on the integrity of the electric drilling tool.

The result of this design is that the insulator on the one hand and the constitution of the high voltage electrodes on the other hand confer to them their mechanical strength with respect to both the compression forces and the torque to which they are subjected during rotary drilling.

In one embodiment, the insulator provides the following two functions:

provides electrical insulation between the high voltage shaft and the grounding part by maintaining a distance between these two parts significantly greater than the distance (34) which separates the ends of the system of high voltage electrode and the ends of the system of grounding electrodes, and also by avoiding the phenomena of uncontrolled propagation of current lines along contact surfaces between two environments of different resistivity, resulting in creation of an electric arc, a phenomena known as "tracking", mechanically joins the body of the electric drilling tool to ground and the system of high voltage electrodes, both in respect of rotary movements and axial movements in order to maintain the space between the ends of the two electrode systems at a constant value (34).

Several geometries of the system of electrodes can be considered:

a single high voltage electrode positioned on the axis of the electric drilling tool and peripheral grounding electrodes of constant dimensions;

a single high voltage electrode positioned centrally but offset (33) relative to the axis of the electric drilling tool and peripheral grounding electrodes (32) of variable dimensions and adjusted to maintain a constant space (34) between their ends and the high voltage electrode (as described in FIG. 11);

a system of high voltage electrodes comprising a central offset electrode (33) and peripheral electrodes (35) interspersed between the grounding electrodes (32), the space (34) between their ends and the high voltage electrode being of constant value (as described in FIG. 12).

The interest in offset high voltage devices is to avoid an insufficient fragmentation rate in the centre part of the hole. The combined effect of the offset position and the rotation thus ensures that no surface of the hole is exempted from the presence of electric arcs. In addition, such an asymmetrical configuration allows arranging the grounding electrodes at varying dimensions. Some are at a large dimension: those that are opposite the central electrode relative to the hole axis. Others are at a small dimension: those that are on the same side as the central electrode relative to the hole axis.

The largest electrodes are of a size compatible with setting on this electrode inserts of, for example, Polycrystalline Diamond Compact (PDC) (61) type or tungsten carbide type or another type of hard and abrasive material without running the risk that these inserts would be dislodged by the electric arcs since the said inserts are sufficiently far from the end of the electrode from which the electric arc is created. Thus the existence of these inserts both on the front face and also on the side face of these electrodes so equipped allow for reinforcing the effect of the electric arcs by mechanical action and protects the electrodes from premature wear caused by the rotation. It is also possible to equip the end of the electrodes with an impregnated matrix (62) comprising powder or microparticles of diamond or any materials intimately mixed with a metal matrix to protect the electrodes from premature wear caused by the rotation. This embodiment is shown in FIG. 15.

Furthermore, the existence of electrodes of small dimension allows electric arcs to be created very close to the periphery of the hole thereby improving the ratio of coverage of the surface of the hole by electric arcs.

In another embodiment, when the system of high voltage electrodes consists of a single central electrode in the axis of the drilling tool, the insulator provides the "electrical insulation" function, mechanically joining the grounding part with the high voltage part from an axial point of view but allowing uncoupling in rotation between these two parts. Thus, such configuration avoids premature wear of the end of the high voltage electrodes.

In another embodiment, the insulator only provides the "electrical insulation" function and allows for mechanical uncoupling both from an axial and rotational point of view between the grounding part and the high voltage part. Thus, such a configuration avoids not only premature wear of the end of the high voltage electrodes but also maintains continuous contact between the electrodes and the ground.

In one embodiment, as illustrated in FIG. 14, the system for rotary drilling by electrical discharge is electrically insulated from the upper part of the drill string by an insulating connector. This connector consists of an upper metal part (58) and a lower metal part (57) separated by an insulator (60). The geometry of the part nesting ensures the absorption of axial stresses as well as the torque stresses. Thus, this connector may be positioned immediately above the electricity generator or higher depending on the architecture of the drill string. This connector contributes to two potential functions:

contributing to the safety of personnel located at the surface, avoiding potential interference with MWD and LWD type electronic equipment.

The invention claimed is:

1. A downhole device for rotary drilling comprising:

an electricity generator installed at the end of a string of drill pipes and/or drill collars and converting a hydraulic drilling fluid into electrical energy;

a pulse generator mechanically and electrically connected to the said electricity generator, and powering a system of active and passive electrodes carried by a drilling tool;

an electric drilling tool, mechanically and electrically connected to the said pulse generator, driven in rotation by the string of drill pipes and/or drill collars and comprising a system of active and passive electrodes; and an electrical slide switch system, wherein:

the electricity generator comprises a turbine comprising a turbine rotor or positive displacement motor comprising a motor rotor, and an alternator comprising an alternator rotor, the turbine rotor of the said turbine or the motor rotor of said positive displacement motor, driven in rotation by the flow of drilling fluid, in turn drives the alternator rotor, and an interface between the said turbine rotor of the turbine or the motor rotor of the positive displacement motor, and the alternator rotor of the alternator, comprises a first electrical slide switch permitting mechanical clutching.

2. The downhole device according to claim 1, in which the electrical slide switch system is incorporated (i) with the said electric drilling tool or (ii) at an interface between the said electrical drilling tool and the said pulse generator or (iii) with the said pulse generator or (iv) between the said pulse generator and the said electricity generator or (v) with the said electricity generator or (vi) above the said electricity generator.

3. The downhole device according to claim 1, wherein the first electrical slide switch is between a part of the electricity generator which converts the hydraulic energy into mechanical energy and a part of the electricity generator which converts the mechanical energy into electrical energy, such that when in an "open" position, the first electrical switch prevents production of electricity, even if the drilling fluid is circulating in a hydraulic compartment; and further comprising a second electrical slide switch at the electric drilling tool such that when in the "open" position the second electrical slide switch forces discharge of the capacitors of the said pulse generator and prevents their charging even when the electrical compartment is producing an electrical current.

4. The downhole device according to claim 1, in which rotation of the said electric drilling tool combines a mechanical effect of the said passive electrodes with an effect of electrical discharges.

5. The downhole device according to claim 1, in which rotation of the said electric drilling tool sweeps an entire surface of the hole with radial electric arcs which are produced between the said passive and active electrodes.

6. The downhole device according to claim 1, in which the electrical slide switch system, playing the role of an electric switch, is in a "normally open" position by means of a mechanical spring holding the electrical slide switch system open and an open state of a power circuit of the said pulse generator and a "short-circuited" state of capacitors through a circuit which connects two terminals of the said capacitors to a discharge resistor.

7. The downhole device according to claim 6, in which the "normally open" position of the said electrical slide switch system is reinforced by a positive action triggered from the surface by injection of drilling fluid in the casing.

8. The downhole device according to claim 1, in which switching from an open position to a closed position of the said electrical slide switch system is enabled by a positive action triggered from the surface consisting of applying a weight on the said electric drilling tool.

9. The downhole device according to claim 1, in which the said system of active and passive electrodes comprises two groups of electrodes electrically insulated from one another but mechanically joined to one another both longitudinally and rotationally, the said groups comprising (i) a group of passive grounding electrodes, and (ii) a group of active high voltage electrodes; or the said system of active and passive electrodes comprises two groups of electrodes electrically insulated from one another but mechanically uncoupled from one another rotationally not uncoupled longitudinally, the said groups comprising (i) a group of passive grounding electrodes, located in the periphery of the said electric drilling tool, and a group of active high voltage electrodes, located centrally in the said electrical drilling tool, and not mechanically joined to the group of passive electrodes such that it is not driven in rotation by it; or the said system of active and passive electrodes comprises two groups of electrodes electrically insulated from one another but mechanically uncoupled from one another both rotationally and a longitudinally, said groups comprising (i) a group of passive grounding electrodes, located in the periphery, and (ii) a group of active high voltage electrodes, located centrally in the said electric drilling tool, equipped with an axial track along an axis of the said electric drilling tool and subjected to the force of a bellows spring enabling the electrodes to be in continuous contact with the rock; or the said system of active and passive electrodes comprises two groups of electrodes electrically insulated from one another but mechanically attached to one another rotationally and not mechanically attached to one another longitudinally, said groups comprising (i) a group of passive grounding electrodes, and (ii) a group of active high voltage electrodes, located off-centre relative to an axis of the said electric drilling tool, equipped with an axial track along the axis of the said electric drilling tool and subjected to the force of a bellows spring allowing the electrodes to be in continuous contact with the rock.

10. The downhole device according to claim 1, in which a terminal part of the electric drilling tool comprises an internal chamber free of any solid materials other than electrodes.

11. The downhole device according to claim 1, in which the said pulse generator is crossed in its axis by a hollow axial tube in insulating material connected mechanically at the lower part of the said pulse generator with a metal tube such that the continuum of the hollow axial tube and the metal tube provides for transmission of the drilling fluid and that the said lower metal tube receives electrical discharges from the said pulse generator.

12. The downhole device according to claim 11, in which several modules composed of energy storage devices and power switches are stacked on one another in an annular space located between the said hollow tube and an exterior metal envelope.

13. The downhole device according to claim 12, in which the said power switches consist of annular electrodes having the form of a ring.

14. The downhole device according to claim 1, in which the said pulse generator is a LTD Linear Transformer Driver type generator or a Marx generator or a TESLA transformer.

15. The downhole device according to claim 1, in which the device also includes an insulating connector consisting of two metal parts, an upper part and a lower part, separated by an insulating material and nested together to transmit the axial stresses as well as the torque stresses between the said upper part and the said lower part.

16. The downhole device according to claim 1, in which the electrodes comprise inserts of hard and abrasive material.

17. The downhole device for rotary drilling, comprising the downhole device according to claim 1, which is incorporated at the end of a drill string comprising an assembly of drill pipes and/or drill collars for transmission of electrical energy and a drilling rig comprising a system for rotary driving of a string of drill pipes and/or drill collars, and drilling pumps for injection of drilling fluid inside the string of drill pipes and/or drill collars.

18. A drilling process, through rotation of the rotary drilling device according to claim 17.

* * * * *